United States Patent [19]

Seifert et al.

[11] Patent Number: 4,519,224

[45] Date of Patent: May 28, 1985

[54] CONTINUOUSLY-OPERATING MACHINE FOR THE TREATMENT OF ANIMAL HIDES AND SKINS

[75] Inventors: Dieter Seifert; Harald Müller, both of Forst; Lothar Müller, Freiberg; Karl Pestel, Karl-Marx-Stadt; Helmut Geissler, Forst, all of German Democratic Rep.

[73] Assignee: VEB Kombinat Textima, Karl-Marx-Stadt, German Democratic Rep.

[21] Appl. No.: 449,932

[22] Filed: Dec. 15, 1982

[30] Foreign Application Priority Data

Dec. 17, 1981 [DD] German Democratic Rep. ... 235884

[51] Int. Cl.[3] ..... C14C 1/00

[52] U.S. Cl. ..... 69/30; 68/9

[58] Field of Search ..... 69/30, 31, 32; 68/9; 60/908

[56] References Cited

U.S. PATENT DOCUMENTS 3,919,865 11/1975 Glandfield ..... 69/30

4,118,959 10/1978 Waite ..... 69/30

4,122,692 10/1978 Dose ..... 69/30

*Primary Examiner*—Werner H. Schroeder

*Assistant Examiner*—Steven N. Meyers

*Attorney, Agent, or Firm*—Jordan and Hamburg

[57] ABSTRACT

The invention relates to a machine for the treatment of animal hides and skins for the purpose of leather and fur manufacture and preservation.

It is the object of the invention to create a machine which guarantees quality treatment of animal hides and skins in an economical way, for leather and fur manufacture and preservation.

The invention has the object of developing a machine, which operates according to the continuous flow principle and which shortens the processing time of hides and skins. This is achieved in the invention in that the continuously-operating machine comprises segments, which each comprise a drum with delivery device, supply conduit, discharge conduit and heating device with temperature regulation device, in that each segment is directly connected to the separation station by means of conduits, in that each drum can be either perforated or unperforated, in that exhaust air conduits are arranged on the shell, and in that the separation station is provided with dye cleaning devices and a device for the restoration of the dye concentration.

36 Claims, 10 Drawing Figures

1
1
1

CONTINUOUSLY-OPERATING MACHINE FOR THE TREATMENT OF ANIMAL HIDES AND SKINS

BACKGROUND OF THE INVENTION AND PRIOR ART STATEMENT

The invention relates to a machine for the treatment of animal hides and skins, intended for use in leather and fur manufacture, as well as for their preservation. It can be used in all businesses and establishments that are engaged in the manufacture of leather and furs, as well as in the preservation of hides and skins.

A continuously-operating machine for the treatment of animal hides and skins previously known is in the form of a spiral device or spiral barrel for the manufacture of leather, as well as for their preservation. The loading takes place at the end of a tube-like continuously-operating machine, which is rotatably arranged around a horizontal axis, and the discharge takes place by automatic ejection of the hides at the opposite end. The interior walls of the continuously-operating machine have an Archimedean spiral (worm) which divides the hollow cylinder into segments. The treatment of hides and skins with chemicals preferably takes place in an aqueous medium (dye) by gyratory movements of the continuously-operating machine. With a complete turn, the hides are moved one segment in the direction of ejection and in this way ejected out when reaching the last segment (Pauligk/Hagen "Lederherstellung", VEB Fachbuchverlag 1973, p. 78; Krasnow B. Ja "Materialien fuer Erzeugnisse aus Leder", Verlag Leichtund Lebensmittelindustrie, Moskau 1981, p. 37, Russ.)

A disadvantage of this continuously-operating machine is that the dye temperature cannot be set and regulated. It is therefore not possible to carry out the treatment process at the technologically optimum temperature, which is preferably above room temperature. This leads to longer reaction times, which in turn result in higher costs of operation and disadvantageous influences on the leather quality, in the form of an increased occurrence of large grains.

Additional disadvantages relate to the loading and especially the discharge of tanning materials and adjuvant substances from the machine, which are preferably supplied to and discharged from the segments in the form of aqueous dye. Although the supply of the individual segments with various substances is principally possible by means of a corresponding number of independent conduits in the hollow axis, the larger diameters of the conduits, which are necessary for a rapid supply of dye and subsequent short reaction times, result in a considerable reduction of the effective volume of the continuously-operating machine, because of the enlargement of the hollow axis. It is particularly disadvantageous in that the dye cannot be emptied out of the segments without first stopping the machine.

An additional continuous process for the treatment of leather is known (Darmstaedter Durchlaufverfahren), in which the hides are hung over rods individually by hand (Das Leder 1980, 31 p. 68, Eduard Roether Verlag Darmstadt). This method has the disadvantage of requiring great manual effort. Furthermore, the hides have to be secured against sliding off the rods.

For the treatment processes of leather and fur manufacture, machines with rotating, perforated interior drums in a stationary sealed shell are also used. The heating of the dye occurs between the rotating drum and the stationary shell. The temperature of the dye can be regulated. Water, liquid and solid chemicals can be automatically supplied and the individual process steps automatically executed according to plan. The disadvantage of this machine is that the loading and discharge of the hides takes place through the same drum- and shell-opening. For this, the machines must be stopped and the drums retained in such a way that the openings of the drum and shell correspond with one another.

The manual removal of the hides from the machine is combined with especially hard physical work and requires considerable non-operational periods of these valuable means of production. A continuous process is not possible with these machines. An additional disadvantage of these machines is that a considerable dye volume is necessary (at least 30 to 40% of the hides to be processed). These machines are not suitable for processes without dye (DE-OS No. 26 48 057).

It is therefore the object of the invention to eliminate these disadvantages and to create a machine, which guarantees quality treatment of animal hides and furs for leather and fur manufacture and preservation in an economical way, and which shortens the process, saves chemical agents and work, reduces the waste water stress and the need for production space, saves electricity, increases the productivity and improves working conditions.

The invention has the object of creating a machine for the treatment of animal hides and skins to be used in leather and fur manufacture and preservation, which operates according to the continuous flow principle and which allows the use of the most practical technology. In order to realize the technologically optimum process, the optimal reaction temperature can be set and regulated. The treatment can take place in long, as well as in short, dyes and also in solutions without dye. The supply of dye and solid chemicals as well as separation of the dye from the hide material occur while the machine is operating and occur so quickly that short time processes are possible, which considerably shorten the processing time of hides and skins. Unused tanning material and chemical adjuvants can be recovered and reused. The machine operates automatically to a great extent.

SUMMARY OF THE INVENTION

The object of the invention is achieved in that the continuously-operating machine comprises segments, each having a drum with a delivery device, supply conduit with inlet, discharge conduit with dye-discharge device and heating apparatus with temperature regulation device, with each segment directly connected to the separation station by means of conduits, each drum possibly being perforated as well as unperforated, exhaust air pipes being located on the shell and terminating in a centralized exhaust air conduit, and with the separation station having a dye cleaning device and a device for restoring the dye concentration. The number of segments depends on the technology guidance, the effective volume of the drum (n), and the hide flow per time unit.

At least one drum is perforated, so that the dye can reach the hides from the shell in the shortest possible time and can be separated from the hides along the same route. The sealed shells, which belong to the segments with perforated drums, are connected via conduits to one or several containers of the dye separation station and to each other. It is thus possible to execute separation processes by the counter-current method. The height of the dye can be regulated by interrupting the flow when reaching the prescribed dye height, or by overflow. The discharge of dye from the shell occurs by draining from the lowest shell point. The dyes resulting from overflow or discharge flow can be entirely or partially returned to the waste water or the dye separation station for the purpose of reuse. Contaminated dyes are cleaned of foreign substances, particularly of hide fibers, in the dye separation stations. Before being returned to the containers of the dye separation station, the dye can additionally be transported through a device to restore the necessary dye concentration.

A quick separation of the dye from the hides and furs can also be achieved when the hide material is transported into a subsequent segment containing no dye. Here, the dye adhering to the hide material flows off through the drum perforations, while the dye of the immediately preceding segment, after supplementing with adjuvants, can be immediately used for the next batch of hide materials. The flowing off dye can be directed either to the waste water or the dye separation station, as previously described.

It is a special characteristic of the invention that the continuously-operating machine can be provided with unperforated drums for the execution of short dye processes or processes without using dye.

The supply of dye or solid chemicals then occurs via the loading opening of the machine, and the separation of the dye residue from the hide material occurs in a subsequent segment with a perforated drum. If the dye residue is to be used again, then the subsequent segment is not prepared with washing dyes or the kind, so that the dye can flow off undiluted from hide material through the perforations, and can be transported to the dye separation station. If, however, the dye residue is not to be recovered, then the subsequent segment can be prepared with washing dye or the kind in order to achieve a quicker separation of the dye residue from the hide material.

The delivery device, a curved shovel-shaped machine element, can have many perforations, in order to pull as little dye as possible along into the next segment when transporting the hides and the skins, or can have no perforations in order to transport the hide material together with the entire dye from the unperforated drums into the next segment. Segments with unperforated drums can be installed with simplified shells or without shells.

The setting and regulation of the dye temperature occurs, as is already known, by a direct or indirect heating device in the shell between the drum and the bottom of the shell. In this connection, it must be taken into consideration that the dye temperature has been already set in the containers of the separation stations, so that heating in the shell has to principally make up temperature losses through the conduit and by radiation, as well as raise the supplied hide material which is at room temperature, to the temperature of the dye. Setting and regulation of reaction temperature in the unperforated drums occurs by means of warm water which is supplied to the shell from the separation station and/or, as is already known, by heat radiation or inductive heating of the drums. In segments without dye, having perforated drums, the temperature of the hide material can be set and regulated by blowing warm air into the shell.

The continuously-operating machine has a separation station, which comprises one or several containers with known measuring-heating and temperature control devices to measure and set the concentration of the chemicals used for treatment as well as to heat and regulate the temperature of the dye, and which are connected to the segments by means of conduits. For recovering and reusing the dye, the separation station is equipped with pumps, dye-cleaning devices, preferably filters, and a device to restore the dye concentration to regulate the concentration level of the additives.

The hides and skins to be treated are supplied to the first drum by means of a loading device. Dye and/or solid chemicals have already been preferably added. During the process, the automatically controlled drive moves one or more drums around a defined angle of rotation, smaller than 360°, in one rotatory direction and then around approximately the same angle, which is preferably between 180° and 200°, in the other rotatory direction. During these gyratory movements, the hide material is lifted by supporting elements such as square webs and/or studs and falls back onto the floor of the drum after having reached a defined height, depending on friction and force of gravity. The superimposed falling of hides and skins (fulling movements) promotes the diffusion of the additives in the hide material or the washing out of the substances, which are to be removed from the hide material. In order to protect the hide materials, the gyratory movements can be interrupted so that the continuously-operating machine remains still for a defined length of time.

With a complete turn of the drum in the ejection direction, the shovel-shaped delivery device grasps the hides and the skins in the drum and conveys them out of the drum. If the continuously-operating machine comprises several segments, the hides are moved to the next drum, before finally being ejected out of the last drum. All drums can make a complete turn at the same time or beginning from the last drum, make one full turn in the direction of ejection, one after another.

It is also possible to set up several continuously-operating machines with automatic delivery of the hides and skins from machine to machine located behind each other, next to each other or in some other way related to each other. The production lines can thus be adjusted to the room conditions, with several unperforated drums supplied with treatment chemicals.

BRIEF DESCRIPTION OF THE DRAWINGS

The invention will be explained in detail below by means of examples. In the corresponding drawings.

DETAILED DESCRIPTION OF A PREFERRED EMBODIMENT

The following is a Glossary of terms and elements employed in the present invention.

GLOSSARY

Figure 1:
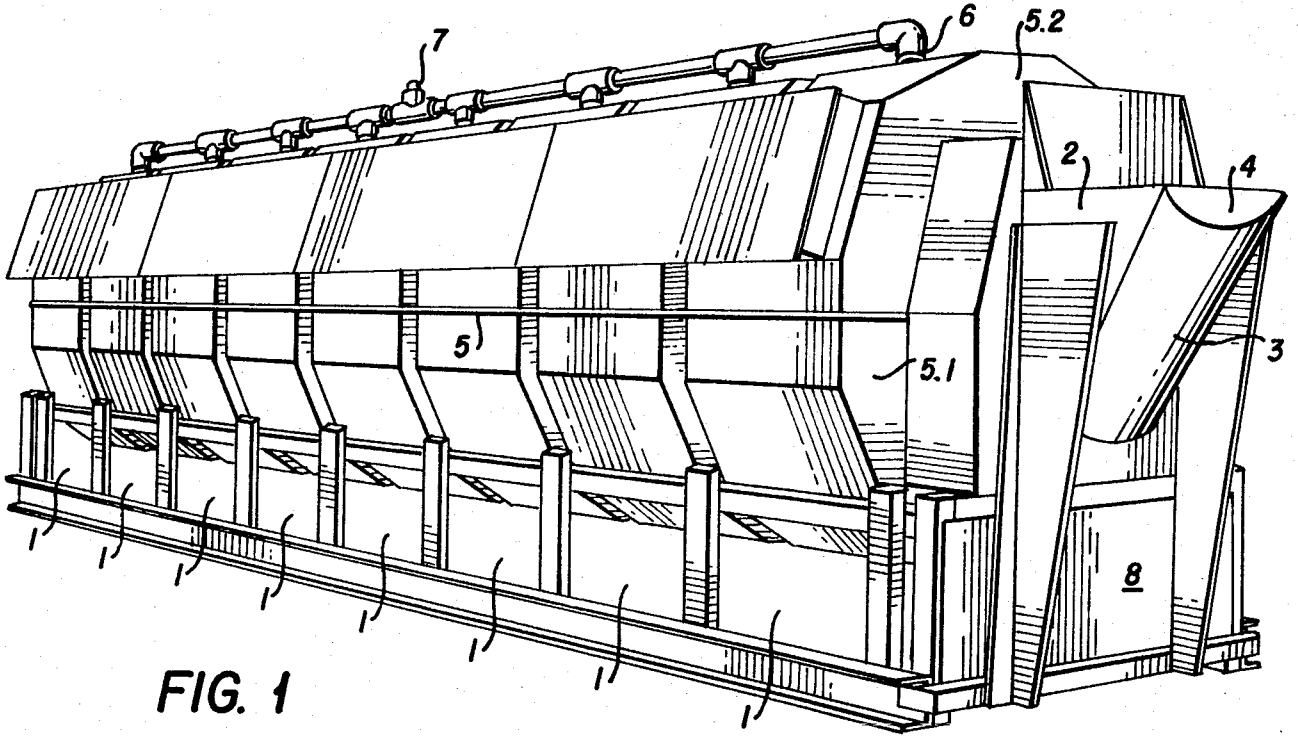
FIG. 1 illustrates a perspective view of the continuously-operating machine from the loading side.

1. Segments
2. Supply slide
3. Bottom wall
4. End wall
5. Shell
5.1 lower vat
5.2 upper vat
6. Exhaust air conduits
7. Centralized exhaust air conduit
8. Support and carrying construction
9. Drums (9.1 to 9.8)
10. Drum shell
11. Drum side wall
12. Delivery device
13. Heating device with temperature regulation device in segment 1–8
14. Separation station
15. Supply conduit system
16. Discharge conduit system
17. Reservoir respectively separation container
18. Inlet of conduit 15
19. Supply conduit for drum 9.1
20. Heating device with temperature regulation device in reservoir 17
21. Dye discharge device in the shell
22. Discharge conduit
23. Spray filter - dye cleaning device
24. Pump
25. Device for the restoration of dye concentration
26. Webs
27. Drive
28. Triple roll chain
29. Guide rolls
30. Toothed wheel
31. Supporting rolls
32. Supporting construction
33. Ring The continuously-operating/continuously-processing machine depicted in FIG. 1 for the treatment of hides and/or skins comprises a row of individual segments 1, the number of which depend on the technological and quantitative requirements for the hide flow. At the supply opening, supply slide 2 is located which comprises a tilted, arched, curved bottom wall 3 and an end wall 4. The hides and/or skins reach the supply slide by means of a known loading device, not depicted in the drawing.

The construction of the individual segments is generally the same and comprises a shell 5 with lower vat 5.1 and upper vat 5.2, and an exhaust air conduit 6 exiting in a centralized exhaust air conduit 7. Shell 5 and drum 9 rest on a support and carrying construction 8, which is connected to the floor or the base in a simple manner by means of stone screws.

Figure 2:
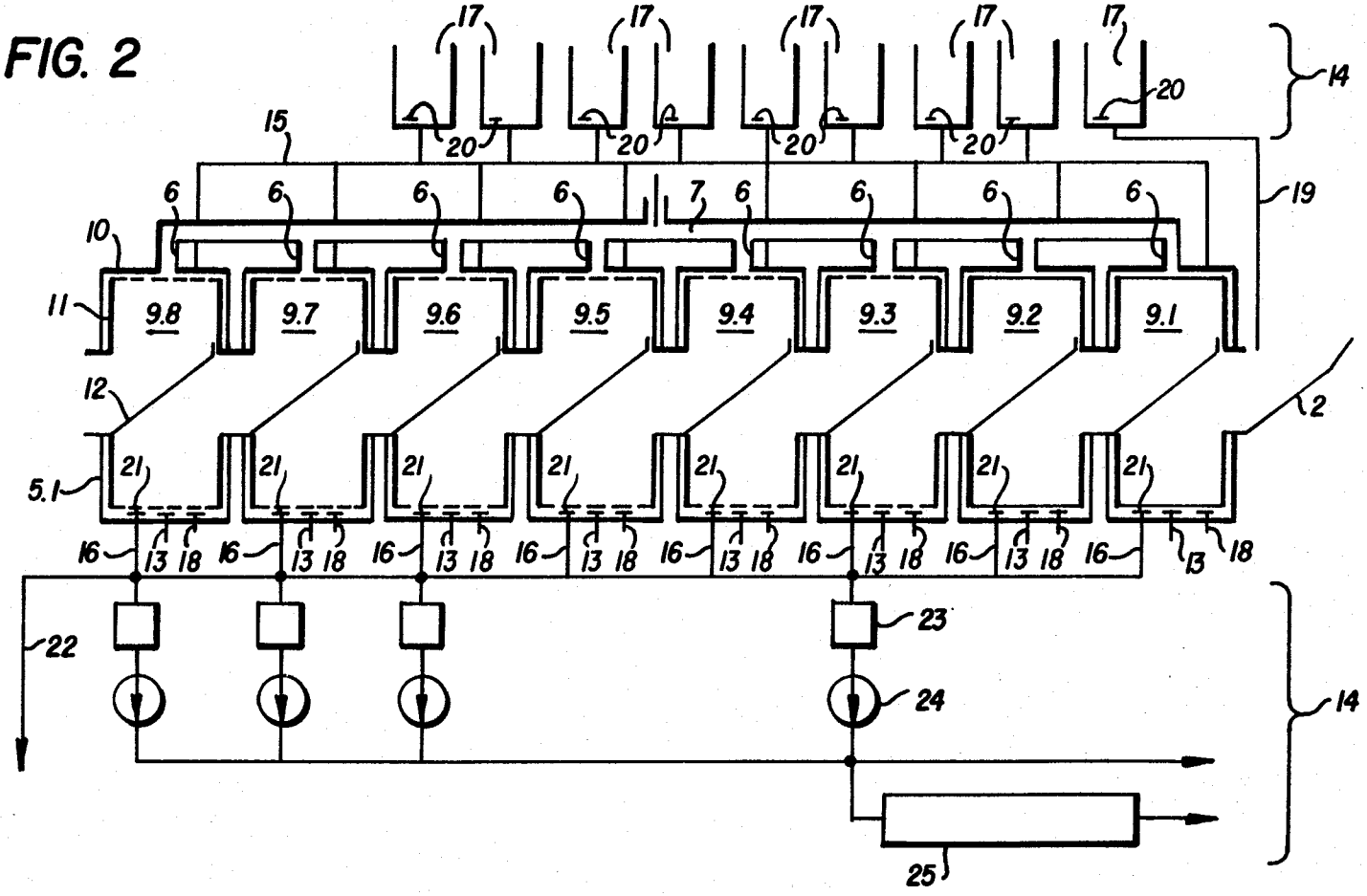
FIG. 2 illustrates a schematic sectional view of the solution according to the invention with separation station and conduit system, FIG. 3 centrally illustrates a side view of a drum, and laterally illustrates sectional views of the drum, taken along sections A—A and B—B of the central view, as shown in FIG. 3 in the central (side) view of the drum.

FIG. 2 depicts the continuously-operating machine according to the invention with perforated and unperforated drums. Drums 9.1 and 9.2 are not perforated for carrying out short dye processes (20% dye per amount of hide), while the cylindrical drum shells 10 of drums 9.3 to 9.8 are perforated for carrying out long dye processes (120% dye per amount of hide). It is known that the perforation enables circulation of the dye through drum shell 10 of drum 9. Drum 9 is formed by side walls 11, drum shell 10 and delivery device 12, which are firmly connected to each other, preferably by welding. Each segment 1 is provided with a known heating and temperature regulation device 13 between lower vat 5.1 and drum 9.

Separation station 14 is connected to the continuously-operating machine by a conduit system 15. On an elevated stand which is not depicted in the drawings, reservoirs 17 are installed. From here, dye or water is supplied to each segment in free fall via conduit system 15. Drum 9.1 receives the additives for treatment of the hide material through a separate conduit 19. The reservoirs 17 contain heating and temperature requlation devices 20. In connection with the heating and temperature regulation devices 13 in shell 5, it is guaranteed that the treatment of the hides and/or furs is always carried out at the technologically optimum temperature, resulting in the highest quality of the final product with shortest possible treatment time. In drums 9.1 and 9.2, hide material and dye are indirectly regulated by warm water in shell 5, according to the technological requirements.

A discharge device 21 is located at the lowest point of the shell. From here, dye or water can be drained out of the system by means of conduit system 16 and returned to the waste water or the waste water separation station, or returned via pumps 24 to the reservoirs 17. The return of the contaminated dye occurs via spray filter 23, removing all hide fibers from the dye. The partially used, diluted dye is transported via a device to restore the dye concentration 25, in order to set the necessary concentration for renewed use.

Exhaust air conduits 6, which are attached to upper vat 5.2, exit in a centralized air conduit 7, onto which a ventilator is preferably attached.

Figure 3A:
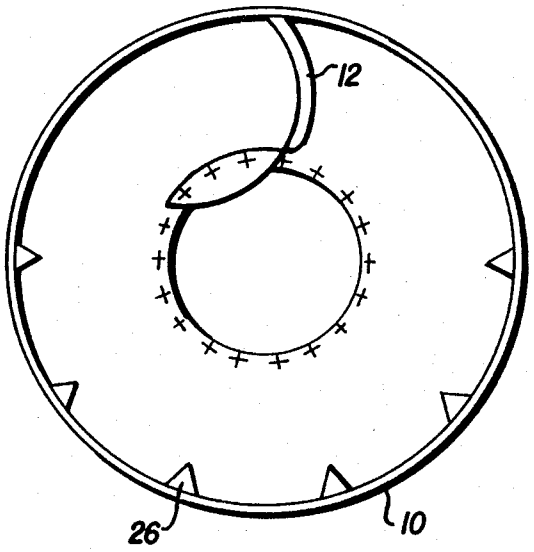
Figure 3:
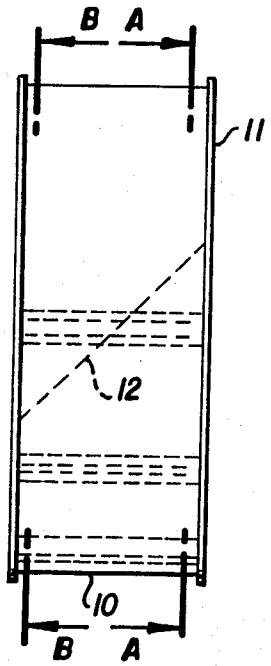
Figure 3B:
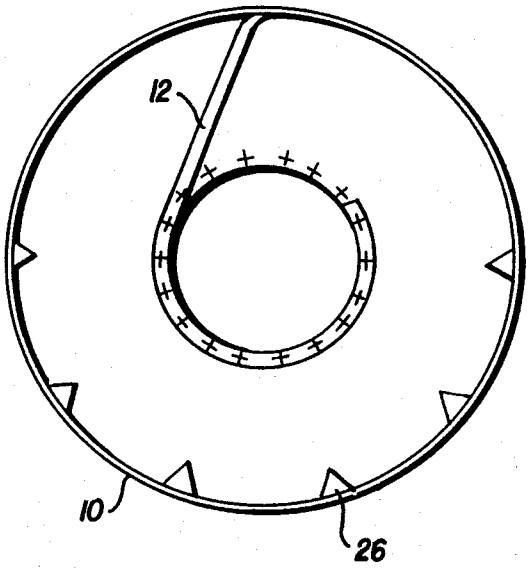

As can be viewed in FIG. 3, the interior space of each drum contains a number of V-shaped webs 26 attached to drum shell 10 in the axial direction, and which are firmly connected to drum shell 10 and drum side wall 11. These wedge-shaped webs 26, which protrude into drum 9, provided that the hides and or skins to be treated are lifted a defined angle at a rotational movement of drum 9, and then from this raised position fall back in a direction pointing towards the deepest drum line. The rotating of hide material and dye accelerate the reactions between the additives and the hide material.

Figure 4:
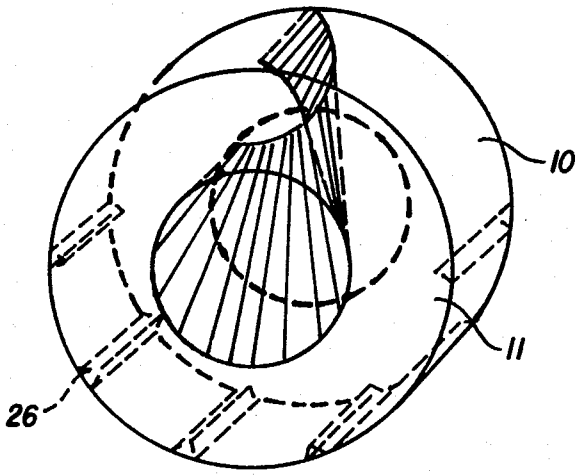
FIG. 4 illustrates the perspective view of a drum.
Figure 5:
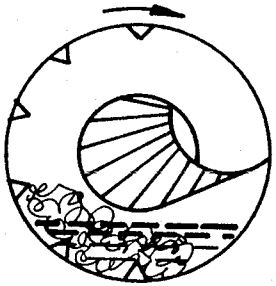
FIGS. 5, 6 and 7 illustrate a schematic view of the various drum positions during the treatment phase, wherein FIGS. 5 and 7 correspond to the extreme positions, while FIG. 6 corresponds to the mean position.
Figure 6:
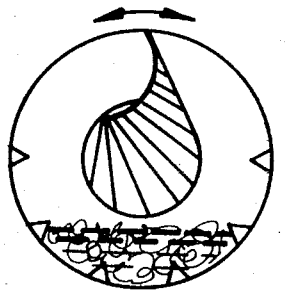
Figure 7:
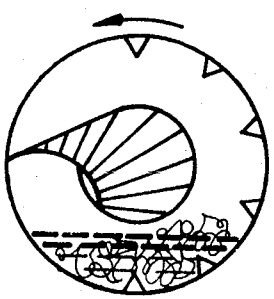

FIG. 4 illustrates a perspective view of drum 9 with curved, shovel-shaped delivery device 12.

FIGS. 5 to 9 depict the mode of operation of drum 9 with delivery device 12. In order to treat the hides, the drum makes a gyratory movement from the extreme position in FIG. 5 over the mean position in FIG. 6 to the extreme position in FIG. 7 and back. Through the V-shaped webs 26, the hide material is lifted and falls back to the deepest drum position.

Figure 8:
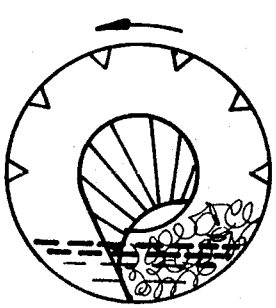
FIGS. 8 and 9 illustrate the positions of the drum during the supply or ejection of the goods to be treated.
Figure 9:
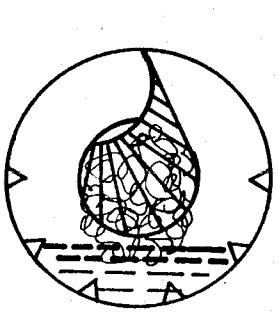

The mode of operation of the delivery device is depicted in FIG. 8 and FIG. 9. When the hides and/or skins are ejected into the next drum 9 or ejected out of the machine, it moves by 180° over the extreme position in FIG. 5 counterclock-wise and grasps all hides and/or skins and conveys them from the position in FIG. 8 to the position in FIG. 9.

Figure 10:
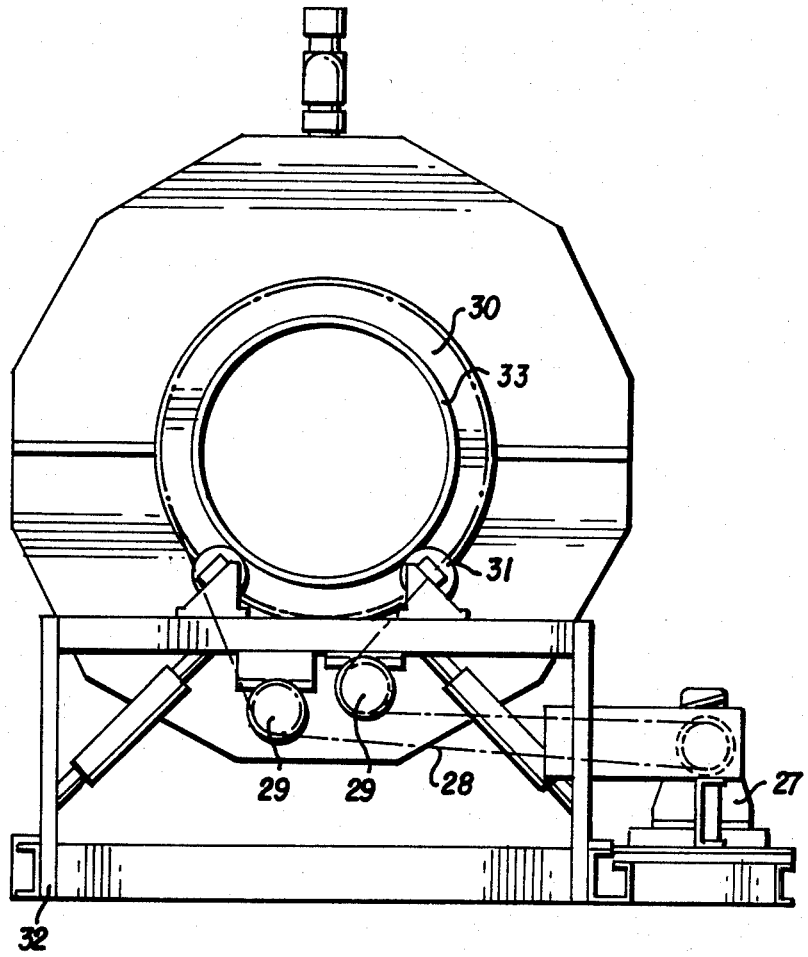
FIG. 10 illustrates the drive of the continuously operating machine.

FIG. 10 illustrates the drive of the continuously-operating machine. The drums are rigidly connected to each other by means of intermediate rings, whereby the drive by engines 27 over triple roll chains 28, guide roll 29 and toothed wheel 30 preferably acts on the first and the last drum of the continuously-operating machine.

The drums are positioned on supporting rolls 31, which are firmly connected with supporting construction 32.

The hide material treated in drum 9.1 in short dye is conveyed to drum 9.2 together with the dye via delivery device 12, following a treatment time of, for example, 10 minutes. Here, the hide material is treated for ten minutes, as in every additional drum 9. Thereafter, the hide material and dye is transported into the empty perforated drum 9.3. Here, the still concentrated dye residue drains off the hide material within 10 minutes and flows to pump 24 via spray filter 23, to be returned to reservoir 17 via the device for restoring dye concentration 25. The substances used during the treatment of the hides are supplemented in reservoir 17. Drum 9.4 is already filled with rinsing water at the beginning of operation of the machine, and the hide material is rinsed during the fourth machine cycle. The supply of rinsing water is measured so that in a machine cycle of 10 minutes, 50 liters of rinsing water for 100 kg of hide material flows from reservoir 17 to and through the overflow. The rinsing water is discharged from the system via discharge conduit 22. In drum 9.5, the rinsed hides are allowed to drain, in order not to dilute the treatment chemicals in drums 9.6 and 9.7 with rinsing water still remaining on the hides. The rinsing water being discharged from drum 9.5 is discharged from the system via discharge pipe 22. The dye in drums 9.6 and 9.7 is carried via reservoir 17 in a circulatory fashion. By means of a measuring and dosage device, the additive concentration in the reservoirs 17 is maintained at the necessary concentration by supplementing the same. Drum 9.8 again serves the draining process.

The treatment chemicals collecting in the shell of drum 9.8 are carried back to the separation container 17 through spray filter 23.

The described process is repeated every 10 minutes with a new batch of the hide material to be treated.

The reservoirs 17, whose functioning has not been described, are necessary for the cleaning of drum and shells.

Hide material and dye are tempered in drums 9.1 and 9.2 by warm water from reservoirs 17, located in shell 5 and set at the necessary treatment temperature by heating and temperature regulation device 13. Inlets 18 for supply conduit system 15 are illustrated in FIG. 2.

It thus will be seen that there is provided a processing machine for the treatment of animal hides and furs which attains the various objects of the invention, and which is well adapted for the conditions of practical use. As various alternatives within the scope of the present invention will occur to those skilled in the art, besides those alternatives, equivalents, embodiments and variations mentioned supra and shown in the drawings, it will be understood that the present invention is not limited to these alternatives or the like, but extends fully to the full range of equivalents contemplated and is to be limited only by the scope of the recitations in the appended claims, as well as equivalents thereof, both structural and functional.

We claim:

1. A continuously-operating machine for the treatment of animal hides and skins comprising a drum, said drum being rotatably positioned around its longitudinal axis and being surrounded by a sealed shell, said drum having a circular loading opening at one end and a circular discharge opening on the oppisite end, said drum of the continuously-operating machine including a plurality of segments, all of which in turn comprise said drum, so that said drum is subdivided in said plurality of segments, said machine including a fluid separation station, a delivery device, supply conduit system with inlet, discharge conduit system with dye discharge device, and heating apparatus with temperature regulation device, each of said segments being connected directly to said separation station via conduits, at least one segment of said drum being perforated, at least one further segment of said drum being unperforated, exhaust air conduits which exit in a centralized exhaust air pipe and which are arranged on said shell, and said separation station having dye cleaning devices and devices to restore the dye concentration.

2. The continuously-operating machine of claim 1, in which the delivery device, beginning at the drum shell, has a curved shape and changes into a principally conical part which connects to the circular edge of the discharge opening.

3. The continuously-operating machine of claim 1, in which webs and/or studs are placed in the drum, so that the fulling movements of the hides are increased.

4. The continuously-operating machine of claim 1, in which the perforations in at least one segment of the drum are circular.

5. The continuously-operating machine of claim 1, in which, in order to carry out the oscillating rotary movement of the drum at a rotational angle which is smaller than 360°, and in the range of about 180° to 200°, switches are provided for obtaining the rotational angle.

6. The continuously-operating machine of claim 1, in which the heating apparatus with temperature regulation device in segment is located between the shell and the drum, and a heating apparatus with temperature regulation device is located in reservoirs of the separation station.

7. The continuously-operating machine of claim 1, in which, in order to regulate the temperature in the unperforated further segment of the drum, water is applied to the further segment, with heating occurring indirectly via the drum shell, and hot air and/or heat radiators are used in the perforated drum segment containing no dye.

8. The continuously-operating machine of claim 1, in which, for the separation of dye residue, a dye cleaning device is provided, said dye cleaning device being located between the dye discharge device and a pump of the separation station.

9. The continuously-operating machine of claim 1, in which, in order to increase the concentration of the additives of the dye residue, a device is provided to restore the dye concentration, said dye concentration restoring device being located between the dye cleaning device and reservoirs of the separation station.

10. The continuously-operating machine of claim 1, in which, for the movement of the drum, a plurality of drives is provided.

11. The continuously-operating machine of claim 1, in which the drum is positioned on fixed or flexible rolls, which are attached to a ring.

12. An apparatus for treating animal hide and/or skin, comprising a drum, said drum being rotatably positioned on its longitudinal axis, said drum having a substantially circular opening at one end for receiving hide and/or skin, and a substantially circular opening at an opposite end for discharging hide and/or skin, a substantially sealed shell surrounding said drum, said drum including a plurality of segments, each of which forms a segment of said drum, a device within said drum for discharging hide and/or skin out of said drum, a conduit for supplying fluid to at least one segment of said drum, said conduit comprising an opening for supplying fluid to said one segment, a device for regulating discharge of fluid from said one segment, said device being situated inside said shell, a conduit for discharge fluid from said one segment, said conduit being engaged with said device for regulating discharge of fluid from said one segment, a heating and temperature regulation device for said one segment, a fluid separation station which is connected with said one segment through said conduit, for supplying fluid to said one segment, and through said conduit for discharging fluid from said one segment, said fluid separation station including a fluid cleaning device and a device for restoring fluid concentration, said apparatus also including an exhaust air conduit situated on said shell, for removing air from said one segment, and a central exhaust air conduit in which said shell-situated exhaust air conduit terminates.

13. The apparatus of claim 12, in which the plurality of segments interconnect with one another.

14. The apparatus of claim 12, in which at least one drum segment is perforated.

15. The apparatus of claim 12, in which the device for discharging hide and/or skin from within said drum has a conically curved shape, gradually increasing in shape from the interior of said drum to the substantially circular opening in the drum for discharging hide and/or skin, with said discharging device curving around and connected to the edge of the substantially circular discharge opening.

16. The apparatus of claim 15, in which the discharge device is perforated.

17. The apparatus of claim 12, in which the drum additionally includes projections along the interior surfaces thereof, to facilitate movement of hide and/or skin through the drum.

18. The apparatus of claim 14, in which the perforations in the perforated drum segment are substantially circular in shape.

19. The apparatus of claim 12, additionally including means for oscillating and rotating the one drum segment at a rotational angle of less than about 360°, to convey hide and/or skin through the drum segment.

20. The apparatus of claim 19, in which the rotational angle is between 180° and 200°.

21. The apparatus of claim 12, in which the heating and temperature regulation device is positioned between the substantially sealed shell and the drum segment.

22. The apparatus of claim 12, in which the fluid separation station includes at least one reservoir engaged with the fluid supply conduit for the drum segments, said reservoir containing fluid for supply to the drum segments through the fluid supply conduit, and a heating and temperature regulation device situated inside said at least one reservoir for regulating temperature of fluid inside said at least one reservoir.

23. The apparatus of claim 12, in which each heating and temperature regulation device for an unperforated drum segment includes means for directing water against the outer surface of said unperforated drum segment, and each heating and temperature regulation device for a perforated drum segment, which does not receive fluid, includes means for directing hot air into said perforated drum segment.

24. The apparatus of claim 12, in which the fluid separation station additionally includes a pump, with the fluid cleaning device situated along the conduit for discharging fluid from the drum segments, between the device for regulating discharge of fluid from the drum segments and said pump.

25. The apparatus of claim 12, in which the fluid separation station additionally includes a device for restoring concentration of the fluid, said device being situated between the fluid cleaning device and at least one reservoir engaged with the fluid supply conduit for the drum segments.

26. The apparatus of claim 12, additionally including at least one drive for rotation of said drum.

27. The apparatus of claim 12, additionally including at least one roll upon which the drum is positioned, and a ring onto which said at least one roll is attached.

28. A continuously-operating machine for the treatment of animal hides and skins comprising a drum, said drum being rotatably positioned around its longitudinal axis and being surrounded by a sealed shell, said drum having a circular loading opening on one end and a circular discharge opening on the opposite end, said continuously-operating machine including a plurality of drum segments, all of which in turn comprises said drum, so that said drum is subdivided in said plurality of segments, said machine including a fluid separation station, a delivery device, supply conduit system with inlet, discharge conduit system with dye discharge device, and heating apparatus with temperature regulation device; said delivery device, beginning at said drum shell, having a curved shape and changing into a principally conical part which connects to the circular edge of said discharge opening; each of said drum segments being connected directly to said separation station via conduits; at least one segment of said drum being perforated, at least one further segment of said drum being unperforated, at least one of said drum segments being provided with webs and/or studs of the same or different size, said webs and/or studs being placed in said one drum segment, in order to increase the fulling movements of the hides; exhaust air conduits which exit in a centralized exhaust air pipe being arranged on said shell; and said separation station having dye cleaning devices and devices to restore the dye concentration.

29. The continuously-operating machine of claim 28, in which the perforations in the perforated drum segment are circular.

30. The continuously-operating machine of claim 28, in which, in order to carry out the oscillating rotary movements of the drum at a rotational angle which is smaller than 360°, and in the range of about 180° to 200°, switches are provided for obtaining the rotational angle.

31. The continuously-operating machine of claim 28, in which the heating apparatus with temperature regulation device in the drum segment, is located between the shell and the drum, and a heating apparatus with temperature regulation device is located in reservoirs of the separation station.

32. The continuously-operating machine of claim 28, in which, in order to regulate the temperature in the unperforated further segment of the drum, water is applied to the further segment, with heating occurring indirectly via the drum shell, and hot air and/or heat radiators are used in the perforated drum segment containing no dye.

33. The continuously-operating machine of claim 28, in which, for the separation of dye residue, a dye cleaning device is provided, said dye cleaning device being located between the dye discharge device and a pump of the separation station.

34. The continuously-operating machine of claim 28, in which, in order to increase the concentration of the additives of the dye residue, a device is provided to restore the dye concentration, said dye concentration restoring device being located between the dye cleaning device and the reservoirs of the separation station.

35. The continuously-operating machine of claim 28, in which, for the movement of the drum, a plurality of drives is provided.

36. The continuously-operating machine of claim 28, in which the drum is positioned on fixed or flexible rolls, said rolls being attached to a ring.

* * * * *